US009280139B2

(12) United States Patent
Saeki et al.

(10) Patent No.: US 9,280,139 B2
(45) Date of Patent: Mar. 8, 2016

(54) IMAGE FORMING APPARATUS

(71) Applicant: Brother Kogyo Kabushiki Kaisha, Nagoya (JP)

(72) Inventors: Masahito Saeki, Nagoya (JP); Hirotaka Tatematsu, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/495,093

(22) Filed: Sep. 24, 2014

(65) Prior Publication Data

US 2015/0093140 A1 Apr. 2, 2015

(30) Foreign Application Priority Data

Sep. 30, 2013 (JP) ..... 2013-203569
Dec. 27, 2013 (JP) ..... 2013-272851

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC . G03G 15/2017; G03G 21/20; G03G 21/206; G03G 2221/1645
See application file for complete search history.

(56) References Cited

U.S. PATENT DOCUMENTS 6,643,131 B1 * 11/2003 Huang ..... 361/697
7,385,813 B2 * 6/2008 Lin ..... 361/695
7,733,540 B2 * 6/2010 Moribe ..... 358/474
2005/0074255 A1 4/2005 Awaya
2008/0240767 A1 * 10/2008 Asahina ..... 399/92
2010/0124018 A1 * 5/2010 Yoshida et al. ..... 361/695
2012/0148290 A1 * 6/2012 Asami ..... 399/92
2012/0282002 A1 * 11/2012 Murasaki ..... 399/329
2012/0328323 A1 * 12/2012 Murooka ..... 399/92
2013/0259511 A1 * 10/2013 Koyama ..... 399/92

FOREIGN PATENT DOCUMENTS

JP 2002-123138 A 4/2002
JP 2003-152924 A 5/2003
JP 2003-307996 A 10/2003
JP 2007-065105 A 3/2007
JP 2008-070743 A 3/2008
JP 2010-039175 A 2/2010

* cited by examiner

*Primary Examiner* — David Gray
*Assistant Examiner* — Carla Therrien
(74) *Attorney, Agent, or Firm* — Burr & Brown, PLLC

(57) ABSTRACT

An image forming apparatus including a fan cover including a wall portion disposed to overlap a rotational axis of a fan in an axis direction along the rotational axis, the wall portion extending in an orthogonal direction perpendicular to the axis direction, a first section disposed on one side relative to the wall portion in the orthogonal direction, the first section having a first opening disposed on one side relative to the fan in the axis direction and on the one side relative to the rotational axis in the orthogonal direction, and a second section disposed on an other side relative to the wall portion in the orthogonal direction, the second section having a second opening disposed on the one side relative to the fan in the axis direction and on the other side relative to the rotational axis in the orthogonal direction.

19 Claims, 7 Drawing Sheets

IMAGE FORMING APPARATUS

CROSS-REFERENCE TO RELATED APPLICATION

This application claims priority under 35 U.S.C. §119 from Japanese Patent Applications No. 2013-203569 filed on Sep. 30, 2013 and No. 2013-272851 filed on Dec. 27, 2013. The entire subject matters of the applications are incorporated herein by reference.

BACKGROUND

1. Technical Field

The following description relates to one or more techniques for an electrophotographic image forming apparatus.

2. Related Art

As an example of electrophotographic image forming apparatuses, an image forming apparatus has been known that includes a fuser unit configured to thermally fix toner onto a recording sheet, and a power supply circuit board that includes a heater element and is configured to supply the fuser unit with electricity. In the known image forming apparatus, the fuser unit and the heater element generate heat. Therefore, in order to suppress a rise in temperature of the apparatus, it is required to radiate and/or discharge the heat.

In view of the above problem, a laser beam printer has been proposed that includes a cooling fan for discharging heat generated by a fuser unit and a heater element to an outside of the printer.

Specifically, in the proposed laser beam printer, the cooling fan is configured to suck hot air around the fuser unit and hot air around the heater element and discharge the hot airs to the outside of the printer.

SUMMARY

In the meantime, recently, a demand for downsizing of image forming apparatuses is increasingly growing. However, if the proposed laser beam printer is downsized, it results in a limited space for disposing the cooling fan and a lowered flexibility for laying out the cooling fan.

In this case, the cooling fan might not sufficiently suck at least one of the hot air around the fuser unit and the hot air around the heater element or efficiently cool the fuser unit and the heater element.

Aspects of the present disclosure are advantageous to provide one or more improved techniques, for an image forming apparatus, which make it possible to efficiently cool elements in a casing of the image forming apparatus even in the case of a limited degree of freedom for laying out a cooling fan.

According to aspects of the present disclosure, an image forming apparatus is provided, which includes a casing, a fan configured to rotate around a rotational axis and let air inside the casing flow, and a fan cover configured to cover the fan, the fan cover including a wall portion disposed to overlap the rotational axis in an axis direction along the rotational axis, the wall portion extending in an orthogonal direction perpendicular to the axis direction, a first section disposed on one side relative to the wall portion in the orthogonal direction, the first section having a first opening disposed on one side relative to the fan in the axis direction and on the one side relative to the rotational axis in the orthogonal direction, and a second section disposed on an other side relative to the wall portion in the orthogonal direction, the second section having a second opening disposed on the one side relative to the fan in the axis direction and on the other side relative to the rotational axis in the orthogonal direction.

According to aspects of the present disclosure, further provided is an image forming apparatus including a casing, a fan configured to let air inside the casing flow, and a fan cover configured to cover the fan, a fuser unit disposed on one side relative to the fan in an axis direction along a rotational axis of the fan, inside the casing, the fuser unit being configured to fix a developer image onto recording medium, a frame disposed on the one side relative to the fan in the axis direction, the frame being configured to support the fuser unit, an upper cover configured to cover an upper side of the fuser unit, an image scanner disposed above the upper cover, the image scanner being configured to read an image of a document sheet, and a board disposed on an other side relative to the frame in the axis direction, the fan cover including an extension wall extending toward the fuser unit, the extension wall being configured to separate a first space configured to accommodate the board from a second space between the upper cover and the image scanner.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings.

1. Overall Configuration of Printer

Figure 1:
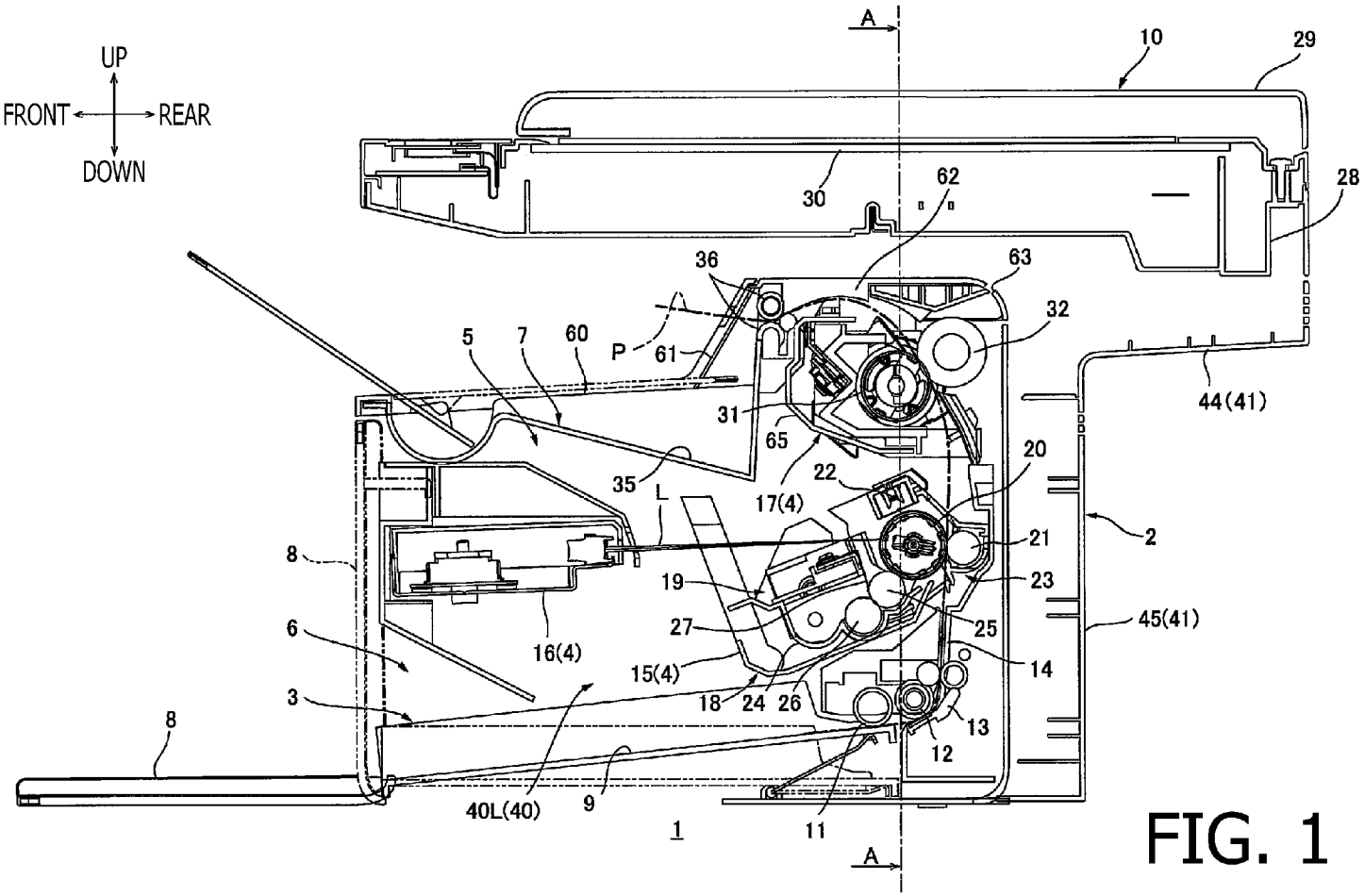
FIG. 1 is a cross-sectional side view of a printer in an illustrative embodiment according to one or more aspects of the present disclosure.

As exemplified in FIG. 1, a printer 1 according to aspects of the present disclosure includes a main body casing 2, a sheet feeder 3, an image forming unit 4, and a flatbed scanner 10.

The main body casing 2 is formed substantially in a box shape, and accommodates the sheet feeder 3 and the image forming unit 4.

It is noted that, in the following description, each direction of the printer 1 will be defined on the basis of a state where the printer 1 is horizontally placed. Specifically, the left side and the right side of FIG. 1 will be defined as a front side and a rear side of the printer 1, respectively. Further, with respect to the sheet surface of FIG. 1, the near side and the far side will be defined as a right side and a left side of the printer 1, respectively. Further, the upper side and the lower side of FIG. 1 will be defined as an upside and a downside of the printer 1, respectively. Namely, a front-to-rear direction and a left-to-right direction of the printer 1 are horizontal directions. Further, an up-to-down direction of the printer 1 is a vertical direction. Moreover, the left-to-right direction of the printer 1 may be exemplified as an axis direction. In this case, the left side of the printer 1 may be exemplified as one side in the axis direction. The right side of the printer 1 may be exemplified as the other side in the axis direction. Further, the up-to-down direction (the vertical direction) of the printer 1 may be exemplified as an orthogonal direction. In this case, the upside of the printer 1 may be exemplified as one side in the orthogonal direction. The downside of the printer 1 may be exemplified as the other side in the orthogonal direction. Furthermore, the front-to-rear direction of the printer 1 may be exemplified as a second orthogonal direction. In this case, the front side of the printer 1 may be exemplified as one side in the second orthogonal direction. The rear side of the printer 1 may be exemplified as the other side in the second orthogonal direction.

(1) Main Body Casing

The main body casing 2 has a cartridge opening 5 and a feeder opening 6. The cartridge opening 5 is disposed at an upper end portion of the main body casing 2. The cartridge opening 5 is formed such that an internal space of the main body casing 2 communicates with an external space of the main body casing 2 via the cartridge opening 5 in the vertical direction. The feeder opening 6 is disposed at a front end portion of the main body casing 2. The feeder opening 6 is formed to penetrate a lower section of the front end portion of the main body casing 2 in the front-to-rear direction.

Further, the main body casing 2 includes a top cover 7 and a feeder cover 8. The top cover 7 is disposed at the upper end portion of the main body casing 2, and is configured to cover the cartridge opening 5 from above. The top cover 7 includes a catch tray 35. The catch tray 35 is recessed downward from an upper surface of the top cover 7.

The top cover 7 is configured to swing around a rear end portion thereof, between a closed position to close the cartridge opening 5 and an open position to open the cartridge opening 5.

The feeder cover 8 is disposed at the front end portion of the main body casing 2, and covers the feeder opening 6 from the front. The feeder cover 8 is configured to swing around a lower end portion thereof, between a closed position to close the feeder opening 6 and an open position to open the feeder opening 6.

(2) Sheet Feeder

The sheet feeder 3 is configured to feed recording media (e.g., sheets P) to the image forming unit 4. The sheet feeder 3 is disposed at a bottom portion inside the main body casing 2. The sheet feeder 3 includes a sheet storage portion 9, a pickup roller 11, a feed roller 12, a feed pad 13, and a feeding path 14.

The sheet storage portion 9 is configured to accommodate leading portions (rear-side portions) of the sheets P. An internal space of the sheet storage portion 9 communicates with the outside of the main body casing 2 via the feeder opening 6 in the front-to-rear direction. When the sheets P are set into the sheet storage portion 9, the feeder cover 8 is placed in the open position, and thereafter, the sheets P are put rearward into the sheet storage portion 9 from the front via the feeder opening 9. Thereby, the leading portions of the sheets P are placed on a bottom wall of the sheet storage portion 9, and trailing portions (front-side portions) of the sheets P are placed on the feeder cover 8 in the open position.

The pickup roller 11 is disposed at an upper rear side of the sheet storage portion 9. The feed roller 12 is disposed apart from and behind the pickup roller 11. The feed pad 13 is disposed at a lower rear side of the feed roller 12, so as to contact a lower rear end portion of the feed roller 12. The feeding path 14 extends upward continuously from a rear end portion of the feed pad 13.

(3) Image Forming Unit

The image forming unit 4 is configured to form an image on a sheet P. The image forming unit 4 includes a process cartridge 15, a scanning unit 16, and a fuser unit 17.

The process cartridge 15 is configured to form a toner image on a sheet P. The process cartridge 15 is detachably attached to the main body casing 2 via the cartridge opening 5. More specifically, the process cartridge 15 is attached to a substantially middle section, in the vertical direction, of a rear portion inside the main body casing 2.

The process cartridge 15 includes a drum cartridge 18 and a development cartridge 19. The drum cartridge 18 includes a drum frame 23, a photoconductive drum 20, a transfer roller 21, and a scorotron charger 22.

The drum frame 23 is formed in the shape of a bottomed rectangular frame. The photoconductive drum 20 is rotatably supported by a rear portion of the drum frame 23. The transfer roller 21 is disposed behind the photoconductive drum 20. A front end portion of the transfer roller 21 is in pressure contact with a rear end portion of the photoconductive drum 20. The transfer roller 21 is rotatably supported by the drum frame 23.

The scorotron charger 22 is spaced apart from the photoconductive drum 20. More specifically, the scorotron charger 22 is disposed at an upper front side of the photoconductive drum 20, and is supported by the drum frame 23.

The development cartridge 19 is detachably attached to the drum frame 23. When attached to the drum frame 23, the development cartridge 19 is disposed at a lower front side of the photoconductive drum 20.

The development cartridge 19 includes a development frame 24, a development roller 25, a supply roller 26, and a layer thickness regulating blade 27. The development frame 24 is formed substantially in a box shape extending in the left-to-right direction. A rear end portion of the development frame 24 is open in the front-to-rear direction. Further, the development frame 24 is configured to store therein development agent (e.g., toner).

The development roller 25 is disposed at a rear end portion of the development frame 24. The development roller 25 is rotatably supported by the development frame 24. Further, an upper portion and a rear portion of the development roller 25 are exposed from the development frame 24. An upper rear end portion of the development roller 25 is in contact with a lower front end portion of the photoconductive drum 20.

The supply roller 26 is disposed at a lower front side of the development roller 25 in the development frame 24. The supply roller is rotatably supported by the development frame 24. Further, an upper rear end portion of the supply roller 26 is in contact with a lower front portion of the development roller 25.

The layer thickness regulating blade 27 is disposed at an upper front side of the development roller 25. The layer thickness regulating blade 27 is supported by the development frame 24 such that a lower end portion of the layer thickness regulating blade 27 contacts a front end portion of the development roller 25.

The scanning unit 16 is disposed at a substantially middle section, in the vertical direction, of a front portion inside the main body casing 2 and positioned in front of the process cartridge 15. As indicated by a solid line in FIG. 1, the scanning unit 16 is configured to emit a laser beam L based on image data toward the photoconductive drum 20, and expose a circumferential surface of the photoconductive drum 20.

The fuser unit 17 is disposed above a rear portion of the process cartridge 15. The fuser unit 17 is disposed to overlap the process cartridge 15 and the feed roller 12 in a plane view (when viewed along the vertical direction).

The fuser unit 17 includes a heating roller 31 and a pressing roller 32. The pressing roller 32 is disposed at an upper rear side of the heating roller 31. A lower front end portion of the pressing roller 32 is in pressure contact with an upper rear end portion of the heating roller 31.

The flatbed scanner 10 is configured to read a document sheet. The flatbed scanner 10 is disposed apart from and above the main body casing 2. The flatbed scanner 10 includes a scanner frame 28 and a document cover 29.

The scanner frame 28 forms a lower portion of the flatbed scanner 10. The scanner frame 28 is formed substantially in a box shape flattened in the vertical direction. An upper wall of the scanner frame 28 includes a reading window 30 made of glass. The document cover 29 forms an upper portion of the flatbed scanner 10. The document cover 29 is formed substantially in a box shape flattened in the vertical direction. The document cover 29 is supported by the scanner frame 28 so as to be swingable around a rear end portion of the document cover 29.

The flatbed scanner 10 is configured to, when a document sheet is set between the reading window 30 and the document cover 29, read an image of the document sheet while controlling a reading sensor (not shown) to slide and scan the document sheet. The printer 1 is configured to perform a below-mentioned image forming operation based on the image data read by the flatbed scanner 10.

(4) Image Forming Operation

In the printer 1, when an image forming operation is started under control by a below-mentioned control board 73, the scorotron charger 22 evenly charges a surface of the photoconductive drum 20. Thereafter, the scanning unit 16 exposes the surface of the photoconductive drum 20. Thereby, an electrostatic latent image based on the image data is formed on the surface of the photoconductive drum 20.

The supply roller 26 supplies the toner stored in the development frame 24 to the development roller 25. At this time, the toner is positively charged by friction between the development roller 25 and the supply roller 26, and is carried on the development roller 25. The layer thickness regulating blade 27 regulates the toner carried on the development roller 25 to be a toner layer with a substantially constant thickness.

The development roller 25 supplies the toner carried thereon with the constant thickness, to the electrostatic latent image on the surface of the photoconductive drum 20. Thereby, the toner image is carried on the surface of the photoconductive drum 20.

When rotated, the pickup roller 11 feeds sheets P placed in the sheet storage portion 9, to a position between the feed roller 12 and the feed pad 13. Then, when rotated, the feed roller 12, in cooperation with the feed pad 13, separates and feeds forward the sheets P fed between the feed roller 12 and the feed pad 13 on a sheet-by-sheet basis. Thus, the feed roller 12, which is rotating, conveys the sheets P onto the feeding path 14 extending in the vertical direction, on a sheet-by-sheet basis at a predetermined moment for each sheet P. Thereby, the sheets P are fed between the photoconductive drum 20 and the transfer roller 21.

Subsequently, when a sheet P passes between the photoconductive drum 20 and the transfer roller 21, the transfer roller 21 transfers the toner image on the photoconductive drum 20 onto the sheet P with a transfer bias.

Thereafter, the sheet P is conveyed to a position between the heating roller 31 and the pressing roller 32. Then, the sheet P is heated and pressed by the heating roller 31 and the pressing roller 32 when passing therebetween. At this time, the toner image on the sheet P is thermally fixed onto the sheet P. After that, the sheet P is conveyed to a position between two ejection rollers 36. The ejection rollers 36 eject the sheet P onto the catch tray 35 of the top cover 7.

Thus, the sheet P is conveyed through a conveyance path that is formed substantially in a C-shape in a side view (when viewed along the left-to-right direction), so as to be fed from the sheet storage portion 9, passes between the photoconductive drum 20 and the transfer roller 21, then passes between the heating roller 31 and the pressing roller 32, and thereafter be ejected onto the catch tray 35.

2. Details about Main Body Casing

Figure 2:
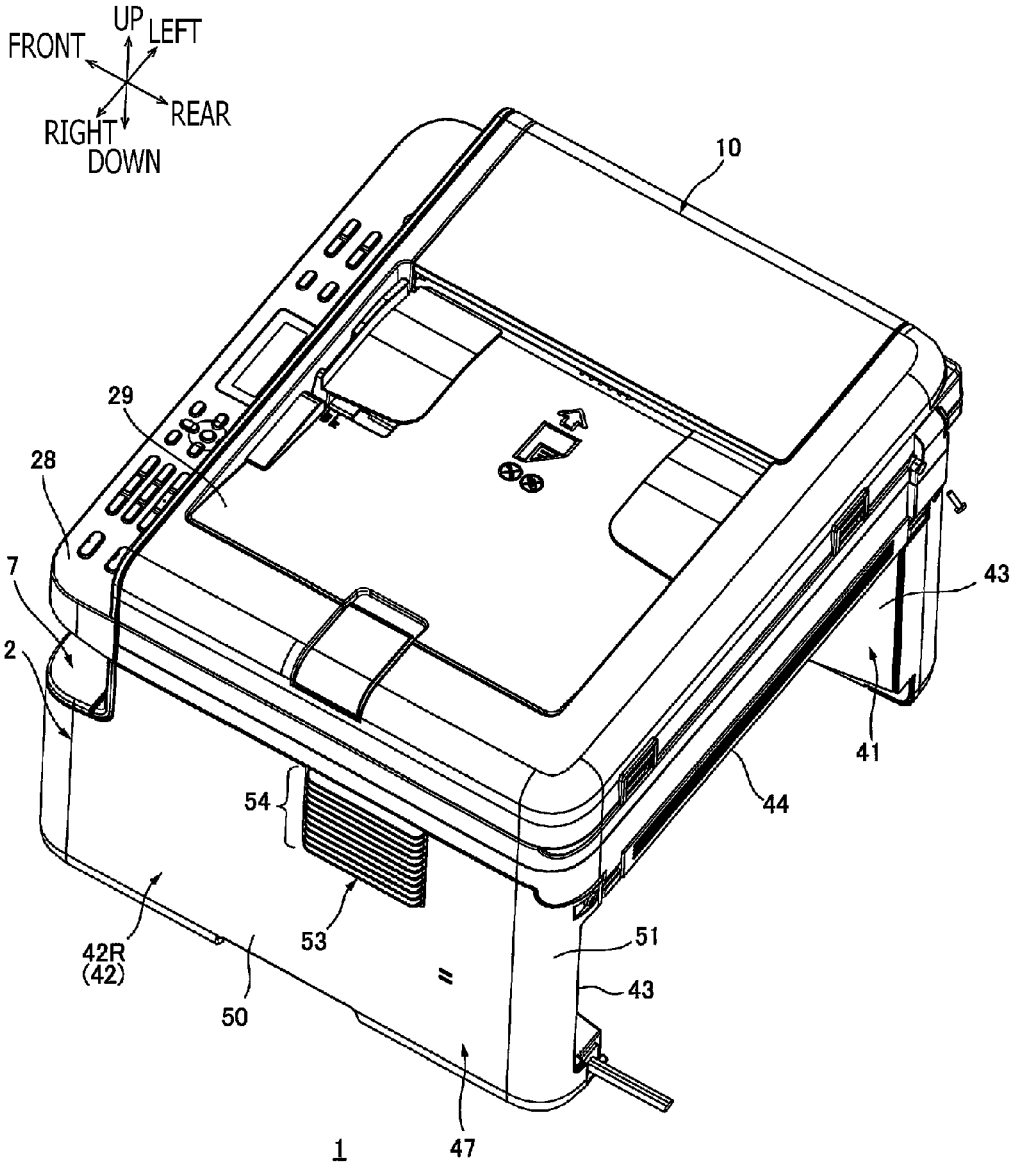
FIG. 2 is a perspective view of the printer when viewed from an upper right side in the illustrative embodiment according to one or more aspects of the present disclosure.
Figure 3:
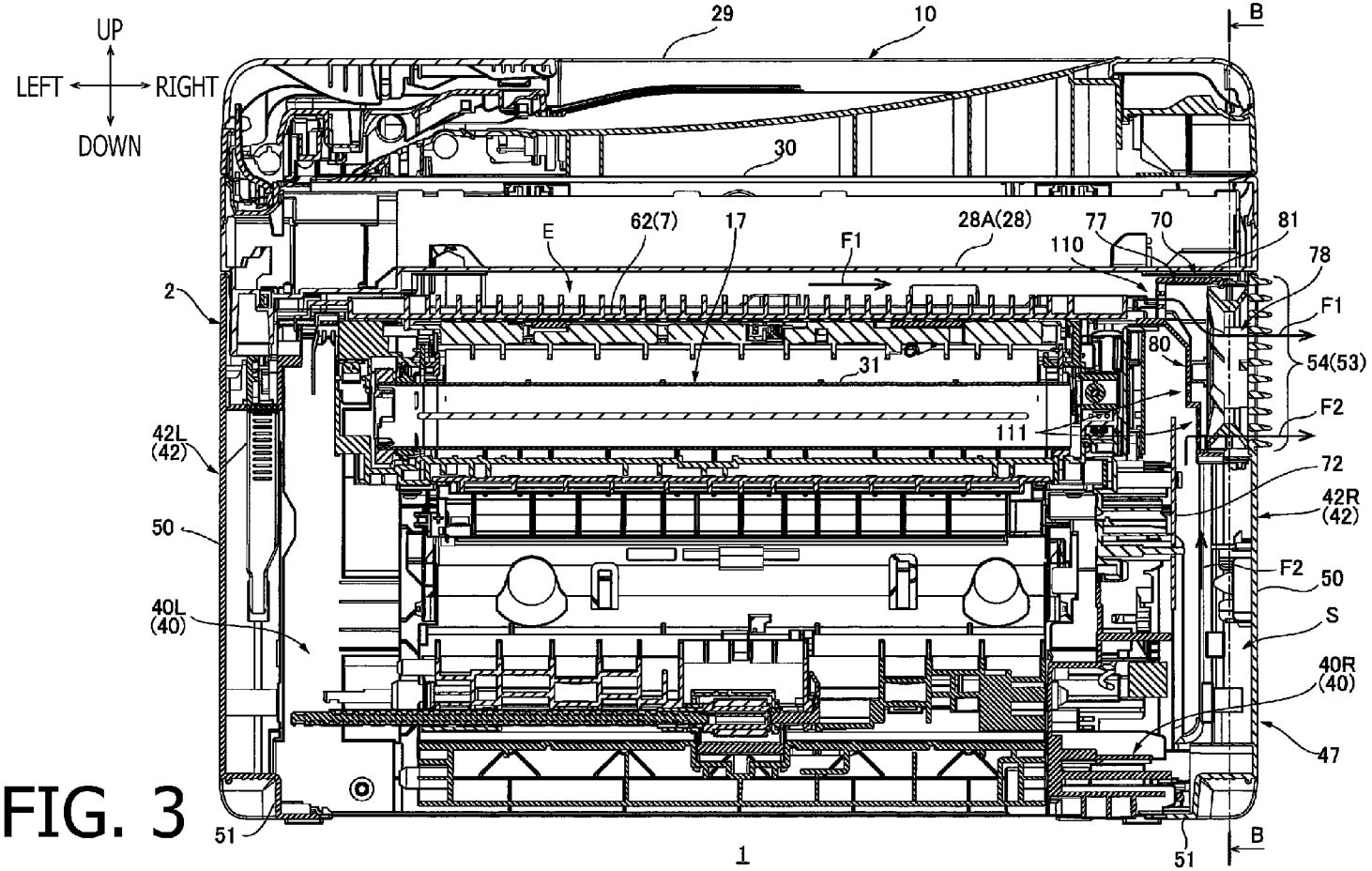
FIG. 3 is a cross-sectional front view taken along a line A-A shown in FIG. 1, showing the printer with a process cartridge detached therefrom in the illustrative embodiment according to one or more aspects of the present disclosure.

As shown in FIGS. 1 to 3, the main body casing 2 includes two side frames 40, a rear frame 41 (as an example of a first cover), and two side covers 42 (as an example of a second cover).

Figure 4:
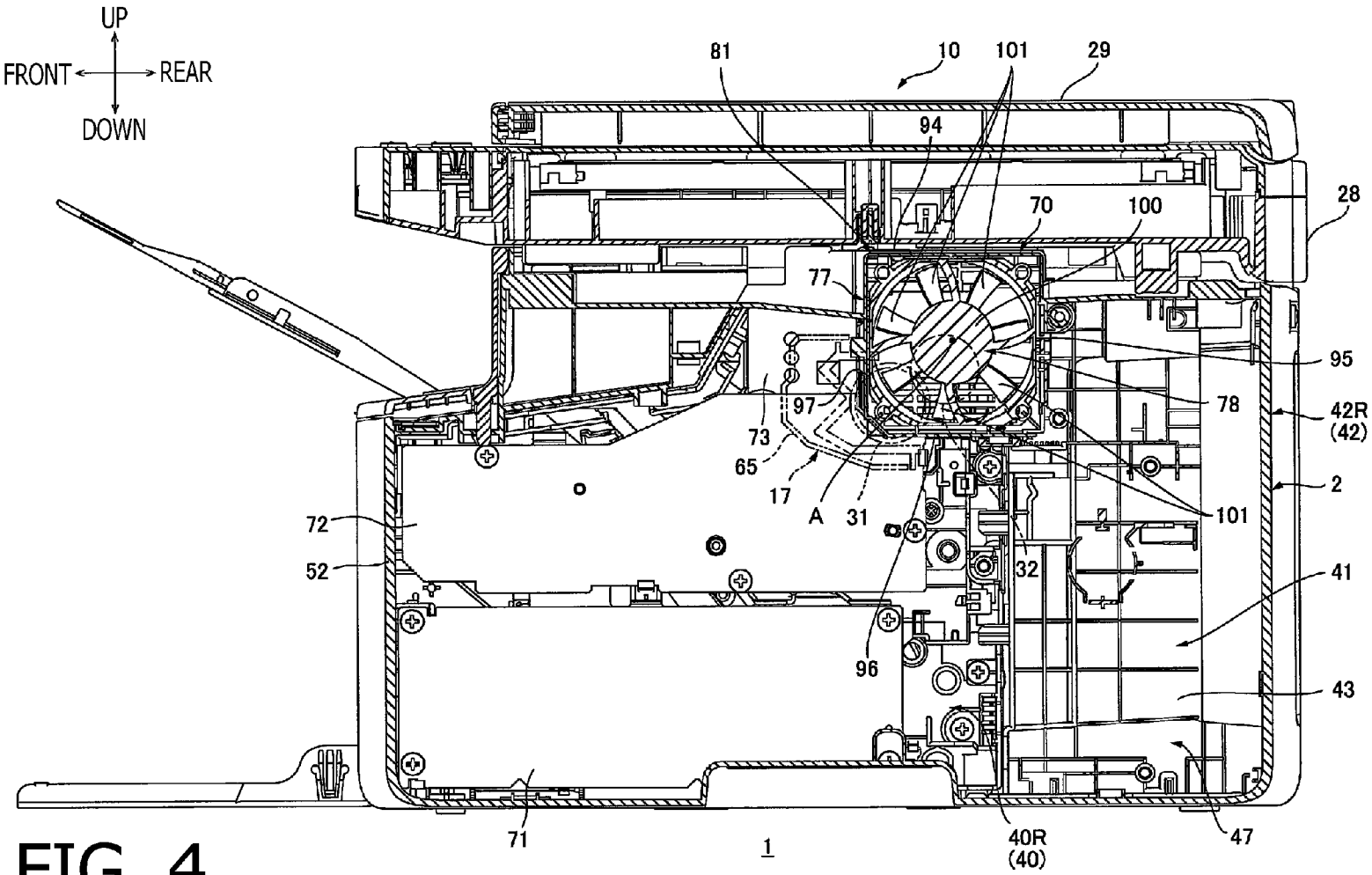
FIG. 4 is a cross-sectional side view of the printer taken along a line B-B shown in FIG. 3 in the illustrative embodiment according to one or more aspects of the present disclosure.

As shown in FIG. 3, the two side frames 40 are disposed to face each other across a distance in the left-to-right direction. The two side frames 40 are disposed under two end portions of the flatbed scanner 10 in the left-to-right direction, respectively. Further, as shown in FIG. 1, the two side frames 40 support two end portions of the image forming unit 4 in the left-to-right direction, respectively. As shown in FIG. 4, each of the two side frames 40 is formed substantially in a rectangular plate shape extending in the front-to-rear direction.

Hereinafter, as shown in FIG. 3, a left one of the two side frames 40 may be referred to as the left side frame 40L, and a right one of them may be referred to as the right side frame 40R.

As shown in FIGS. 1 and 4, the rear frame 41 is disposed under a rear portion of the flatbed scanner 10 and behind the two side frames 40. As shown in FIGS. 1, 2, and 4, the rear frame 41 is formed substantially in the shape of a box open rearward and downward. The rear frame 41 includes two rear side walls 43, a rear upper wall 44, and a rear front wall 45.

As shown in FIG. 2, the two rear side walls 43 are two end portions of the rear frame 41 in the left-to-right direction, respectively, and face each other across a distance in the left-to-right direction. As shown in FIG. 4, each rear side wall 43 is formed substantially in the shape of a vertically-extending rectangular plate in a side view. The two rear side walls 43 are disposed behind and adjacent to the two side frames 40, respectively. Namely, a right one of the two rear side walls 43 is disposed behind the right side frame 40R, so as to face the right side frame 40R in the front-to-rear direction. Likewise, a left one of the two rear side walls 43 is disposed behind the left side frame 40L, so as to face the left side frame 40L in the front-to-rear direction.

As shown in FIG. 1, the rear upper wall 44 is an upper end portion of the rear frame 41 and configured to bridge a distance between respective upper end portions of the two rear side walls 43. The rear front wall 45 is a front end portion of the rear frame 41 and configured to bridge a distance between respective front end portions of the two rear side walls 43. An upper end portion of the rear front wall 45 is connected with a front end portion of the rear upper wall 44.

As shown in FIGS. 2 and 3, the two side covers 42 are two end portions of the main body casing 2 in the left-to-right direction, respectively, and form side parts of an exterior of the main body casing 2 in the left-to-right direction. Hereinafter, a left one of the two side covers 42 may be referred to the left side cover 42L, and a right one of them may be referred to as the right side cover 42R.

Figure 5:
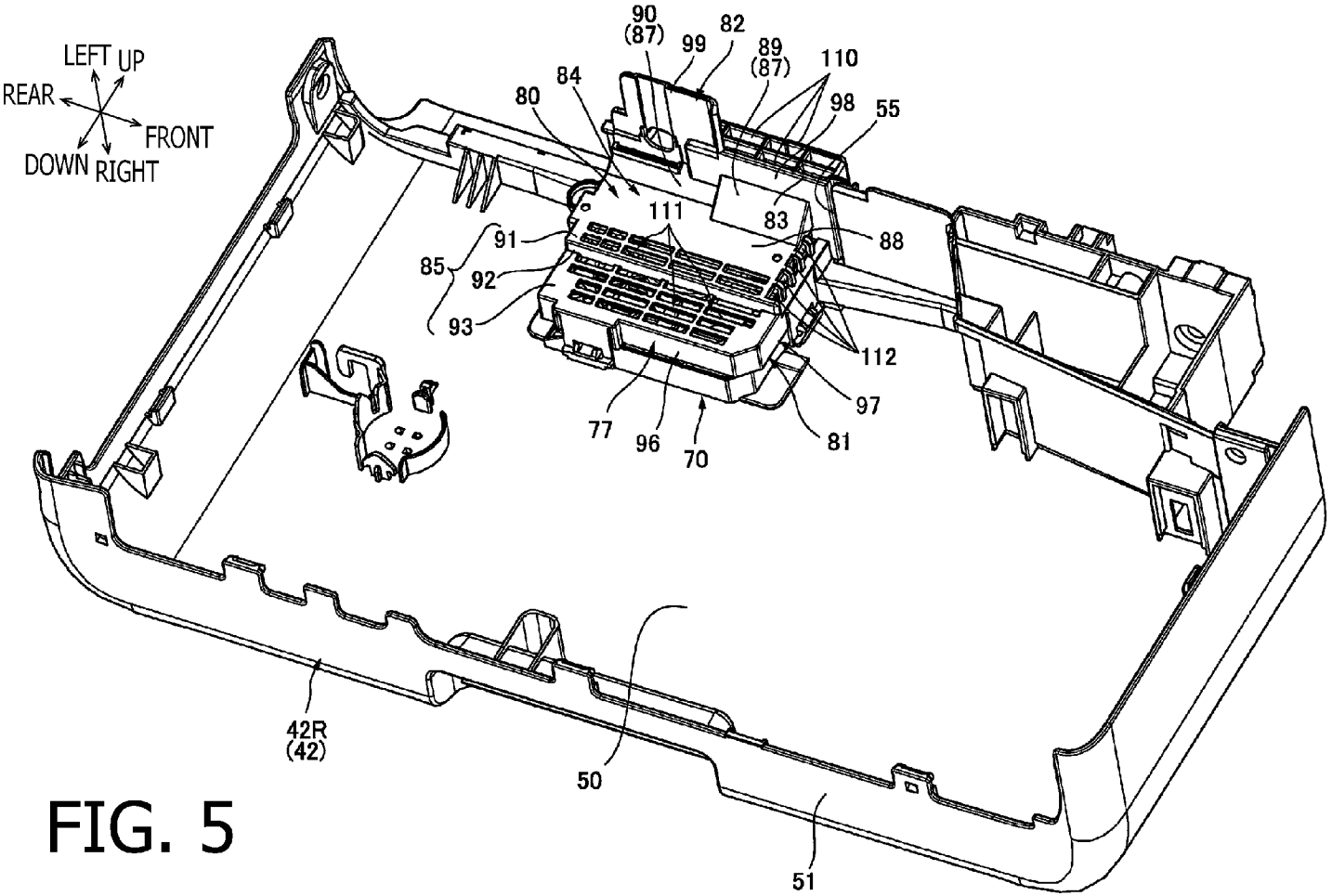
FIG. 5 is a perspective view of a fan unit and a right side cover of the printer when viewed from a lower left side in the illustrative embodiment according to one or more aspects of the present disclosure.

As shown in FIG. 5, each of the two side covers 42 is formed substantially in the shape of a box open inward in the left-to-right direction and provided integrally with a plate 50 and a circumferential side wall 51.

Each plate 50 is formed substantially in a rectangular plate shape extending in the front-to-rear direction in a side view (i.e., when viewed along the left-to-right direction). Each plate 50 has such a size as to collectively and wholly cover the corresponding side frame 40 and the corresponding rear side wall 43 from the outside in the left-to-right direction. Each circumferential side wall 51 protrudes inward from a circumferential end portion of the corresponding plate 50.

Further, as shown in FIGS. 2 and 5, the right side cover 42R includes a vent port 53 and a cutout portion 55.

The vent port 53 is disposed at a substantially middle section, in the front-to-rear direction, of an upper portion of the plate 50. The vent port 53 includes a plurality of slits 54. Each slit 54 is substantially formed to linearly extend in the front-to-rear direction, in a side view. As shown in FIG. 3, each slit 54 penetrates the plate 50 in the left-to-right direction. The plurality of slits 54 are arranged in parallel at regular intervals in the vertical direction.

As shown in FIG. 5, the cutout portion 55 is disposed at a rear portion of an upper wall of the circumferential side wall 51. The cutout portion 55 is formed substantially in a U-shape open leftward, in a plane view. The cutout portion 55 is formed to be cut out rightward from a left end portion of the upper wall of the circumferential side wall 51.

As shown in FIGS. 2 and 4, each side cover 42 is configured to collectively and wholly cover the corresponding side frame 40 and the corresponding rear side wall 43 from the outside in the left-to-right direction. Thereby, as shown in FIG. 3, the plate 50 of the right side cover 42R is disposed apart from the right side frame 40R, on a right side of the right side frame 40R. The right side cover 42R, the right side frame 40R, and a right one of the rear side walls 43 form an enclosure 47 that defines an accommodation space S inside the enclosure 47.

3. Details about Top Cover and Fuser Unit

As shown in FIG. 1, the top cover 7 is an upper end portion of the main body casing 2. The top cover 7 is disposed apart from and under the flatbed scanner 10. The top cover 7 is formed substantially in a crank shape in a side view. The top cover 7 is provided integrally with a front section 60, a stepped section 61, and a rear section 62.

The front section 60 is a front portion of the top cover 7. The front section 60 is formed substantially in a rectangular plate shape in a plane view. The stepped section 61 is a substantially middle portion of the top cover 7 in the front-to-rear direction. The stepped section 61 extends continuously from a rear end portion of the front section 60 toward an upper rear side. The rear section 62 is a rear portion of the top cover 7. The rear section 62 extends rearward continuously from an upper end portion of the stepped section.

Further, the top cover 7 includes the catch tray 35 and a plurality of through-holes 63.

The catch tray 35 is disposed at a substantially middle portion of the front section of the top cover 7 in a plane view. The catch tray 35 is recessed downward from an upper surface of the front section 60. The plurality of through-holes 63 are arranged in parallel in the left-to-right direction, at a rear end portion of the rear section 62 of the top cover 7. Each through-hole 63 penetrates the rear section 62 in the vertical direction.

The fuser unit 17 is disposed behind the catch tray 35 and under the rear section 62 of the top cover 7, inside the main body casing 2. The fuser unit 17 includes a fuser frame 65, as well as the heating roller 31 and the pressing roller 32. The fuser frame 65 is formed substantially in the shape of a box open rearward. The fuser frame 65 is configured to accommodate the heating roller 31 and rotatably support the heating roller 31.

4. Fan Unit

Further, as shown in FIG. 4, the printer 1 includes a fan unit 70, a low-voltage board 71, a high-voltage board 72, and a control board 73.

As shown in FIGS. 3 and 5, the fan unit 70 is disposed on a left surface of the plate 50 of the right side cover 42R. The fan unit 70 is attached to a substantially middle portion, in the front-to-rear direction, of an upper portion of the left surface of the plate 50, so as to face the vent port in the left-to-right direction.

Figure 6:
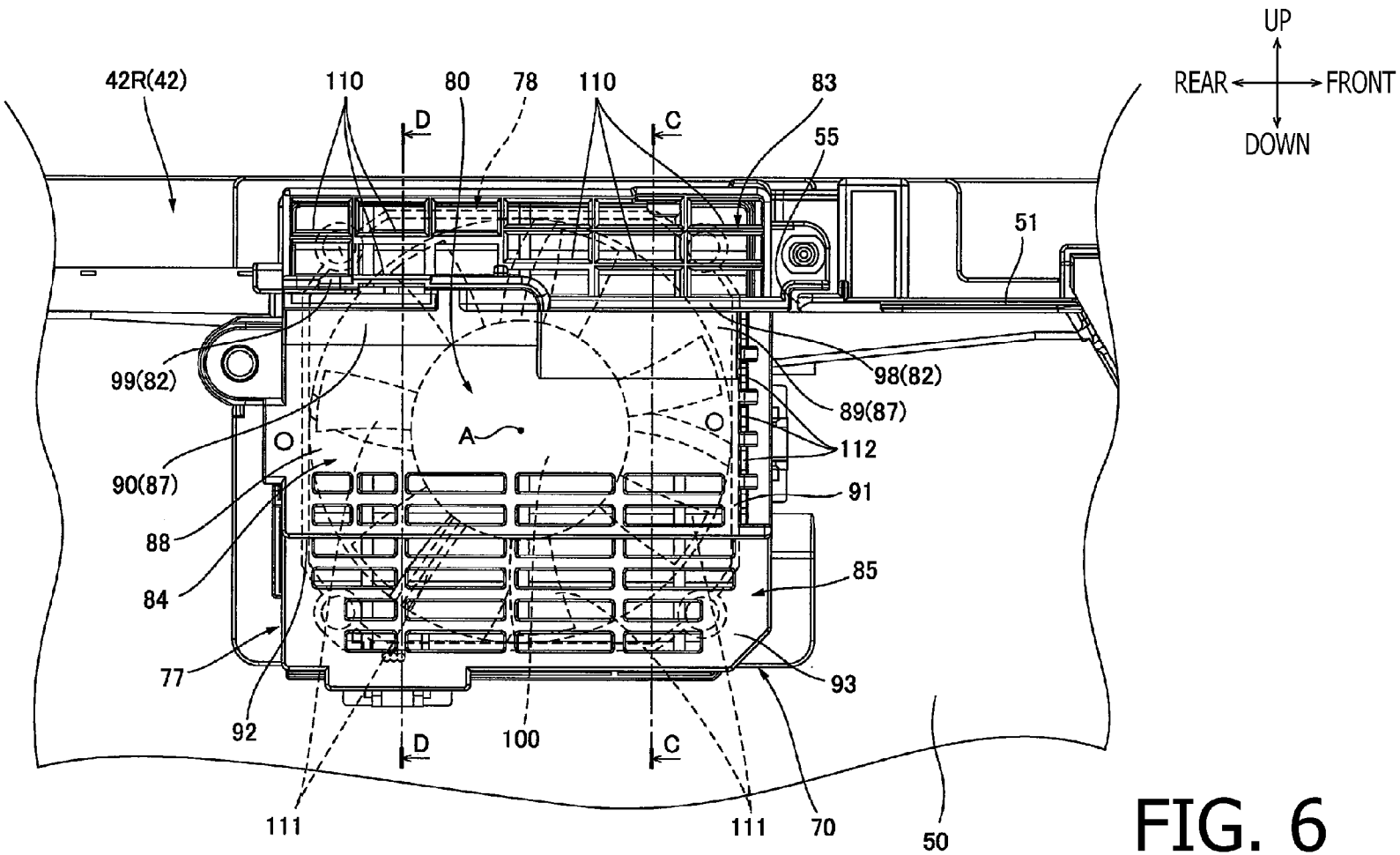
FIG. 6 is a left side view of the fan unit in the illustrative embodiment according to one or more aspects of the present disclosure.

As shown in FIG. 6, the fan unit 70 includes a fan 78 and a fan cover 77.

As shown in FIG. 4, the fan 78 includes a cylindrical portion 100 and a plurality of blades 101. The cylindrical portion 100 is formed substantially in a cylindrical shape extending in the left-to-right direction. The plurality of blades 101 are arranged at intervals in a circumferential direction on an outer circumferential surface of the cylindrical portion 100. Each blade 101 extends outward from the cylindrical portion 100 in a radial direction of the cylindrical portion 100.

As shown in FIG. 6, the fan 78 is supported by the plate 50 of the right side cover 42R, so as to be rotatable around a rotational axis A that is a center axis line of the cylindrical portion 100.

Figure 7B:
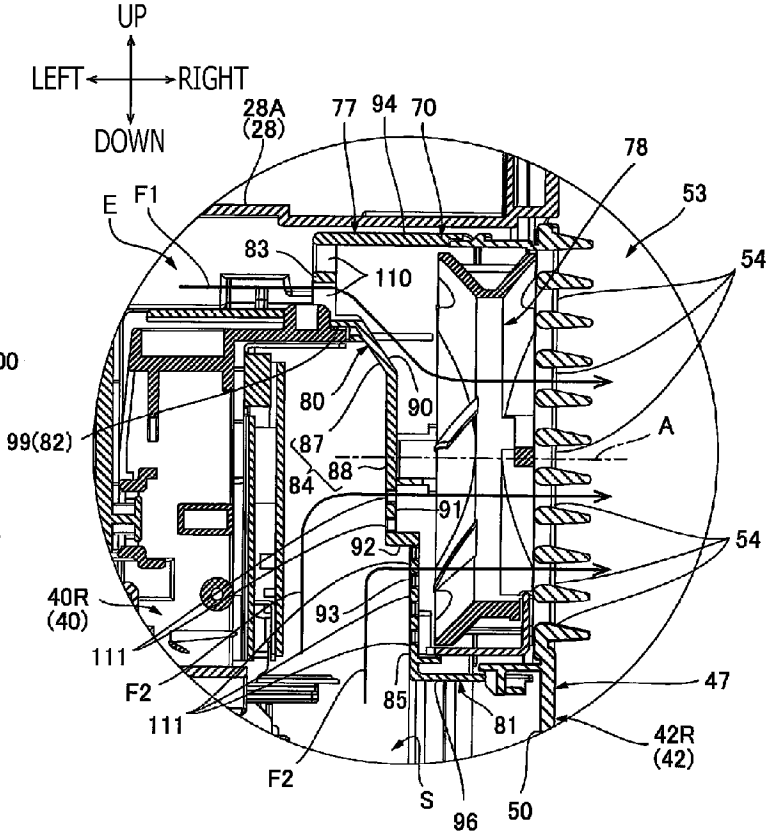
FIG. 7B is a cross-sectional front view of the fan unit taken along a line D-D shown in FIG. 6 in the illustrative embodiment according to one or more aspects of the present disclosure.
Figure 7A:
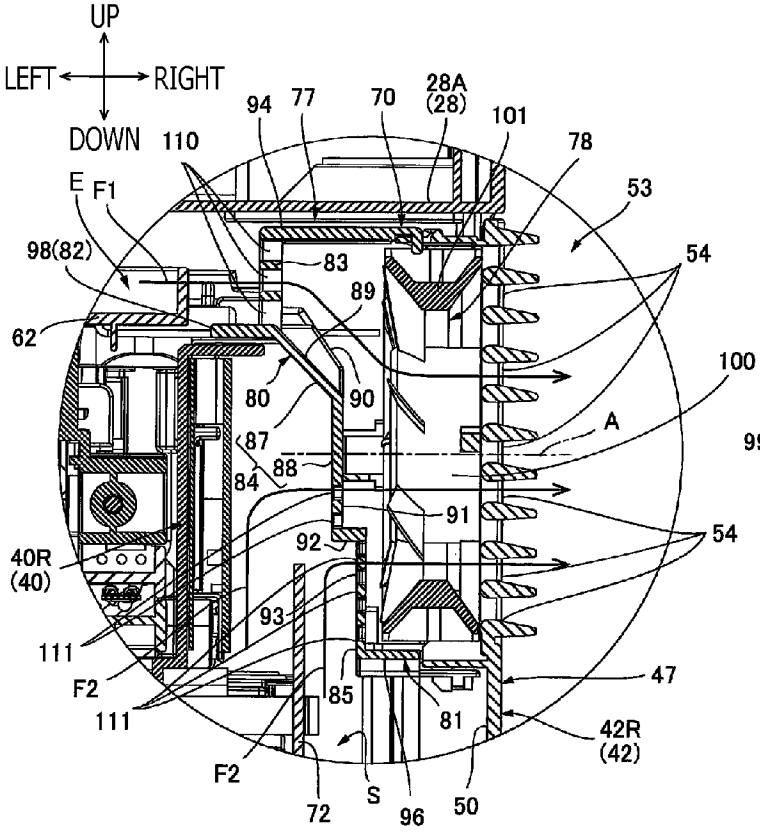
FIG. 7A is a cross-sectional front view of the fan unit taken along a line C-C shown in FIG. 6 in the illustrative embodiment according to one or more aspects of the present disclosure.

As shown in FIG. 7A, the fan cover 77 is formed substantially in the shape of a box open rightward and configured to accommodate the fan 78. The fan cover 77 is provided integrally with a cover plate 80, a cover circumference side wall 81, and an extension wall 82.

The cover plate 80 is a left end portion of the fan cover 77. The cover plate 80 is disposed to face the fan across a distance, on a left side of the fan 78. As shown in FIG. 5, the cover plate 80 is formed substantially in a rectangular shape in a side view. The cover plate 80 includes a first section 83, a regulation wall 84, and a second section 85.

As shown in FIG. 6, the first section 83 is an upper end portion of the cover plate 80. The first section 83 is disposed apart from and above the rotational axis A of the fan 78. The first section 83 is formed substantially in a rectangular shape extending in the front-to-rear direction, in a side view. As shown in FIG. 7A, the first section 83 extends along the vertical direction.

As shown in FIG. 6, the regulation wall 84 is disposed at a substantially middle portion of the cover plate 80 in the vertical direction. In other words, the regulation wall 84 is disposed under the first section 83, to be continuous from the first section 83. As shown in FIGS. 7A and 7B, the regulation wall 84 is formed substantially in an L-shape in a side view. The regulation wall 84 includes an inclined section 87 and a parallel section 88.

The inclined section 87 extends downward continuously from a lower end portion of the first section 83. Further, the inclined section 87 is inclined to the right toward a lower end of the inclined section 87. Specifically, as shown in FIG. 6, the inclined section 87 includes a first inclined portion 89 and a second inclined portion 90.

The first inclined portion 89 is a front portion of the inclined section 87. As shown in FIG. 7A, the first inclined portion 89 extends downward continuously from a front portion of the lower end portion of the first section 83. Further, the first inclined portion 89 is inclined to the right toward a lower side of the first inclined portion 89.

As shown in FIG. 6, the second inclined portion 90 is a rear portion of the inclined section 87. The second inclined portion 90 is disposed adjacent to and behind the first inclined portion 89. As shown in FIG. 7B, the second inclined portion 90 extends downward continuously from a rear portion of the lower end portion of the first section 83. Further, the second inclined portion 90 is inclined to the right toward a lower side of the second inclined portion 90.

As shown in FIGS. 7A and 7B, an inclination angle of the second inclined portion 90 inclined downward with respect to a horizontal direction is larger than an inclination angle of the first inclined portion 89 inclined downward with respect to the horizontal direction. Therefore, as shown in FIGS. 7A and 7B, a gap between the second inclined portion 90 and the fan 78 in the left-to-right direction is narrower than a gap between the first inclined portion 89 and the fan 78 in the left-to-right direction. Further, as shown in FIG. 6, a lower end portion of the second inclined portion 90 is positioned higher than a lower end portion of the first inclined portion 89. Thereby, a volume of a space defined by the first inclined portion 89 and the fan 78 is larger than a volume of a space defined by the second inclined portion 90 and the fan 78. It is noted that a rear end portion of the first inclined portion 89 is connected with a front end portion of the second inclined portion 90.

The parallel section 88 extends downward continuously from a lower end portion of the inclined section 87. The parallel section 88 is parallel to the front-to-rear direction and the vertical direction. As shown in FIG. 6, the parallel section 88 is disposed to overlap the rotational axis A of the fan 78 in a side view (i.e., when viewed along the left-to-right direction).

As shown in FIG. 6, the second section 85 is a lower portion of the cover plate 80. Further, the second section 85 is disposed beneath the parallel section 88 to be continuous with the parallel section 88. Therefore, the second section 85 is disposed below the rotational axis A of the fan 78.

As shown in FIG. 7A, the second section 85 is formed substantially in a crank shape in a side view. The second section 85 includes a separate portion 91, a continuous portion 92, and a neighbor portion 93.

The separate portion 91 is an upper portion of the second section 85. Further, the separate portion 91 extends downward continuously from a lower end portion of the parallel section 88.

The continuous portion 92 is a substantially middle portion of the second section 85 in the vertical direction. Further, the continuous portion 92 extends rightward continuously from a lower end portion of the separate portion 91. Further, as shown in FIG. 6, the continuous portion 92 is disposed lower than the rotational axis A of the fan 78. A substantially middle portion of the continuous portion 92 in the front-to-rear direction is substantially coincident with a lower end portion of the cylindrical portion 100, more specifically, disposed slightly higher than a lower end edge of the cylindrical portion 100, when viewed along the left-to-right direction. Namely, the continuous portion 92 is disposed between the rotational axis A of the fan 78 and the lower end edge of the cylindrical portion 100.

As shown in FIG. 7A, the neighbor portion 93 is a lower portion of the second section 85. Further, the neighbor portion 93 extends downward continuously from a right end portion of the continuous portion 92. Therefore, the neighbor portion 93 is disposed on a right side of the parallel section 88 and the separate portion 91, i.e., disposed closer to the fan 78 than the parallel section 88 and the separate portion 91. In other words, the parallel section 88 and the separate portion 91 are separated farther away from the fan 78 than the neighbor portion 93.

As shown in FIG. 5, the cover circumference side wall 81 protrudes rightward continuously from a circumferential end portion of the cover plate 80. Specifically, as shown in FIGS. 4 and 5, the cover circumference side wall 81 includes an upper cover wall 94, a rear cover wall 95, a bottom cover wall 96, and a front cover wall 97.

As shown in FIG. 7A, the upper cover wall 94 extends rightward continuously from an upper end portion of the first section 83. The rear cover wall 95 extends rightward from a rear end portion of the cover plate 80. Further, as shown in FIG. 4, an upper end portion of the rear cover wall 95 is connected with a rear end portion of the upper cover wall 94. As shown in FIG. 7A, the bottom cover wall 96 extends rightward continuously from a lower end portion of the neighbor portion 93. As shown in FIG. 4, a rear end portion of the bottom cover wall 96 is connected with a lower end portion of the rear cover wall 95.

As shown in FIG. 5, the front cover wall 97 extends rightward continuously from a front end portion of the cover plate 80. Namely, the front cover wall 97 extends rightward from respective front end portions of the first section 83, the regulation wall 84, and the second section 85. Further, a lower end portion of the front cover wall 97 is connected with a front end portion of the bottom cover wall 96. An upper end portion of the front cover wall 97 is connected with a front end portion of the upper cover wall 94.

As shown in FIGS. 7A and 7B, the extension wall 82 extends leftward (i.e., toward a side of the fuser unit 17) continuously from a connecting portion between the first section 83 and the inclined section 87, so as to be farther away from the fan 78. Namely, the extension wall 82 extends leftward continuously from an upper end portion of the inclined section 87. More specifically, the extension wall 82 includes a first extension wall 98 and a second extension wall 99.

As shown in FIG. 5, the first extension wall 98 is a front portion of the extension wall 82. Further, the first extension wall 98 is formed substantially in a plate shape extending in the front-to-rear direction, in a plane view. As shown in FIG. 7A, the first extension wall 98 extends leftward from a connecting portion between a front portion of a lower end portion of the first section 83 and an upper end portion of the first inclined portion 89.

As shown in FIG. 5, the second extension wall 99 is a rear portion of the extension wall 82. Further, the second extension wall 99 is disposed adjacent to and behind the first extension wall 98. The second extension wall 99 is formed substantially in a rectangular plate shape in a plane view. As shown in FIG. 7B, the second extension wall 99 extends leftward from a connecting portion between a rear portion of a lower end portion of the first section 83 and an upper end portion of the first inclined portion 89. In addition, as shown in FIG. 5, a dimension of the second extension wall 99 in the left-to-right direction is more than a dimension of the first extension wall 98 in the left-to-right direction.

Further, as shown in FIG. 6, the fan cover 77 includes a plurality of first openings 110, a plurality of second openings 111, and a plurality of third openings 112.

The plurality of first openings 110 are disposed in a grid pattern at the first section 83 of the cover plate 80. Specifically, the first openings 110 are disposed at an upper end portion of the cover plate 80. Further, each first opening 110 is formed substantially in a rectangular shape in a side view, and penetrates the first section 83 in the left-to-right direction.

The plurality of second openings 111 are disposed in a grid pattern at the separate portion 91 and the neighbor portion 93 of the cover plate 80. Namely, the second openings 111 are disposed at a lower portion of the cover plate 80, i.e., at an opposite side of the first openings 110 with respect to the rotational axis A of the fan 78.

Therefore, the regulation wall 84 is disposed between the plurality of first openings 110 and the plurality of second openings 111 in the vertical direction, and is positioned closer to the first openings 110 than the rotational axis A of the fan 78. Further, as shown in FIGS. 7A and 7B, the inclined section 87 is inclined to the left toward an upper end portion thereof close to the first openings 110 from a lower end portion thereof close to the second openings 111. Namely, respective lower end portions of the first inclined portion 89 and the second inclined portion 90 are positioned on a side close to the second openings 111. Respective upper end portions of the first inclined portion 89 and the second inclined portion 90 are positioned on a side close to the first openings 110. The lower end portion of the first inclined portion 89 is disposed closer to the second openings 111 than the lower end portion of the second inclined portion 90.

Each second opening 111 is formed substantially in a rectangular shape in a side view. Each second opening 111 penetrates the separate portion 91 and the neighbor portion 93 in the left-to-right direction. The second openings 111 are not disposed at the continuous portion 92. Further, a summation of opening areas of the second openings 111 is more than a summation of opening areas of the first openings 110. Specifically, the summation of the opening areas of the second openings 111 is 2-4 times as large as the summation of the opening areas of the first openings 110.

As shown in FIG. 5, the plurality of third openings 112 are arranged in parallel in the vertical direction, at a middle portion in the vertical direction of a left portion of the front cover wall 97. Each third opening 112 is formed substantially in a rectangular shape in a front view. Each third opening 112 penetrates the front cover wall 97 in the front-to-rear direction.

As shown in FIGS. 3 and 4, the fan unit 70 is disposed to face the right side frame 40R and an upper end portion of an adjoining part of the right rear side wall 43 across a distance, at a right side of them. Thereby, as shown in FIG. 4, the fan 78 is disposed to face an upper rear end portion of the right side frame 40R and an upper front end portion of the right rear side wall 43 across a distance, on a right side of the upper rear end portion of the right side frame 40R and the upper front end portion of the right rear side wall 43.

As shown in FIG. 3, the fan unit 70 is disposed on an opposite side of the fuser unit 17 with respect to the right side frame 40R. Further, as shown in FIG. 4, the fan 78 is disposed such that a lower front end portion of the fan 78 overlaps the heating roller, when viewed along the left-to-right direction. Furthermore, a front end portion of the fan 78 is disposed behind a front end portion of the fuser frame 65.

Further, as shown in FIG. 3, the extension wall 82 is disposed adjacent to and above an upper end portion of the right side frame 40R. An upper end portion of the fan unit 70 is disposed higher than the upper end portion of the right side frame 40R, via the cutout portion 55. Thereby, as shown in FIG. 7A, the plurality of first openings 110 are disposed higher than the rear section 62 of the top cover 7 and the right side frame 40R. Further, the plurality of first openings 110 are configured to communicate with an exhaust space E into which air is discharged from the fuser unit 17. The exhaust space E is formed between the rear section 62 of the top cover 7 and a lower end portion 28A of the scanner frame 28.

Meanwhile, as shown in FIG. 3, a lower portion of the fan unit 70 is disposed in the accommodation space S of the enclosure 47. As shown in FIG. 7A, the plurality of second openings 111 are configured to communicate with the accommodation space S.

5. Low-Voltage Board, High-Voltage Board, and Control Board

The low-voltage board 71, the high-voltage board 72, and the control board 73 are housed in the accommodation space S of the enclosure 47.

As shown in FIG. 4, the low-voltage board 71 is supported by a lower portion of a right surface of the right side frame 40R. The low-voltage board 71 is formed substantially in a rectangular plate shape extending in the front-to-rear direction, in a side view. The low-voltage board 71 is configured to convert, into a direct current, an alternating current supplied to the printer 1 from an external power supply.

The high-voltage board 72 is supported by the right surface of the right side frame 40R, above the low-voltage board 71. The high-voltage board 72 is formed substantially in a rectangular plate shape extending in the front-to-rear direction, in a side view. Further, the high-voltage board 72 is disposed on a lower front side of the fan unit 70. As shown in FIG. 3, an upper rear end portion of the high-voltage board 72 is disposed apart from the neighbor portion 93 of the cover plate 80, on a left side of the neighbor portion 93.

Further, the high-voltage board 72 is electrically connected with the low-voltage board 72. The high-voltage board 72 includes a transformer (not shown). The high-voltage board 72 is configured to, when controlled by the control board 73, convert a direct current supplied from the low-voltage board 71 into a predetermined voltage, and supply the predetermined voltage to the scorotron charger 22, the transfer roller 21, the supply roller 26, and the development roller 25.

The control board 73 is supported by the right surface of the right side frame 40R, above a rear end portion of the high-voltage board 72 and in front of the fan unit 70. The control board 73 is formed substantially in a rectangular plate shape in a side view. The control board 73 is configured to control each operation by the printer 1. The control board 73 is electrically connected with the low-voltage board 71 and the high-voltage board 72.

6. Air Currents in Main Body Casing

In the printer 1, when the fan 78 is driven to rotate, air flows in the main body casing 2, and air currents arise. Specifically, when the fan 78 rotates, as shown in FIG. 7A, air between the fan 78 and the cover plate 80 flows rightward, and is discharged out of the main body casing 2 via the vent port 53. It results in a drop in pressure within the fan cover 77.

Then, the air in the exhaust space E between the rear section 62 of the top cover 7 and the lower end portion 28A of the scanner frame 28 is introduced into the fan cover 77 via the plurality of first openings 110. Further, the air in the accommodation space S of the enclosure 47 is introduced into the fan cover 77 via the plurality of second openings 111.

As shown in FIG. 1, the air between the rear section 62 of the top cover 7 and the lower end portion 28A of the scanner frame 28 includes the air heated by the heating roller 31 of the fuser unit 17 and discharged toward a space above the rear section 62 via the through-holes 63.

Then, as shown in FIG. 3, when the air in the exhaust space E between the rear section 62 and the lower end portion 28A of the scanner frame 28 is introduced into the fan cover 77, a first air current F1 flowing toward the fan 78 is generated in the exhaust space E. Namely, the first air current F1 flows rightward from the left over the rear section 62.

Thereafter, when the first air current F1 reaches a point above the extension wall 82, as shown in FIGS. 7A and 7B, the first air current F1 is drawn by the fan 78 being driven, into the fan cover 77 via the plurality of first openings 110. The first air current F1 drawn into the fan cover 77 is guided by the inclined section 87 toward the rotational axis A of the fan 78. Thereafter, the first air current F1 advances rightward and is discharged out of the main body casing 2 via the vent port 53.

Meanwhile, when the air in the accommodation space S of the enclosure 47 is introduced into the fan cover 77, as shown in FIG. 3, in the accommodation space S of the enclosure 47, generated is a second air current F2 flowing toward the fan 78 from around the low-voltage board 71, the high-voltage board 72, and the control board 73. Namely, the second air current F2 flows upward from the lower side in the accommodation space S.

After that, when the second air current F2 reaches a left side of a lower portion of the fan unit 70, as shown in FIGS. 7A and 7B, the second air current F2 is drawn by the fan 78 being driven, into the fan cover 77 via the plurality of second openings 111. Thereafter, the second air current F2 advances rightward, and is discharged out of the main body casing 2 via the vent port 53.

7. Advantageous Effects

As shown in FIG. 6, the regulation wall 84 is disposed to overlap the rotational axis A of the fan 78 when viewed along the left-to-right direction.

Therefore, air currents generated around the rotational axis A of the fan 78 are regulated and restricted by the regulation wall 84 from flowing along the left-to-right direction. Then, as shown in FIGS. 7A and 7B, the regulation wall 84 guides the regulated air currents. Hence, it is possible to regulate respective airflow amounts of air passing through the first openings 110 and the second openings 111.

Thus, it is possible to secure an airflow amount required for effectively cooling elements in the main body casing 2, with respect to the air passing through the first openings 110 and the second openings 111. Consequently, even though the fan 78 has to be disposed with a limited flexibility for lying out the fan 78, it is possible to effectively cool the elements in the main body casing 2.

As shown in FIGS. 7A and 7B, the inclined section 87 is inclined to the left (i.e., to be farther away from the fan 78) toward the upper end portion thereof close to the first openings 110 from the lower end portion thereof close to the second openings 111. Therefore, the space between the fan 78 and the inclined section 87 becomes wider toward the upper end portion, close to the first openings 110, of the inclined section 87 from the lower end portion, close to the second openings 111, of the inclined section 87. Namely, of the space between the fan 78 and the inclined section 87, a partial space on a side close to the first openings 110 is secured wider than a partial space on a side close to the second openings 111.

When the fan 78 is driven to rotate, the air between the fan 78 and the inclined section 87 flows. At this time, between the fan 78 and the inclined section 87, a larger amount of air flows at the side close to the first openings 110 than at the side close to the second openings 111. Thus, it is possible to increase the airflow amount of air passing through the first openings 110.

As shown in FIGS. 7A and 7B, the inclined section 87 is disposed closer to the first openings 110 than the rotational axis A (i.e., disposed higher than the rotational axis A). Therefore, even though the summation of the opening areas of the first openings 110 is less than the summation of the opening areas of the second openings 111, it is possible to suppress a reduction in the airflow amount of air passing through the first openings 110.

As shown in FIGS. 7A and 7B, the volume of the space defined by the first inclined portion 89 and the fan 78 is larger than the volume of the space defined by the second inclined portion 90 and the fan 78. Therefore, it is possible to secure a larger airflow amount of air passing through front-side first openings 110 of the plurality of first openings 110 than an airflow amount of air passing through rear-side first openings 110 of the plurality of first openings 110.

As shown in FIG. 6, the lower end portion of the first inclined portion 89 is disposed closer to the second openings 111 than the lower end portion of the second inclined portion 90. Therefore, it is possible to certainly secure a larger volume of the space defined by the first inclined portion 89 and the fan 78 than the volume of the space defined by the second inclined portion 90 and the fan 78.

As shown in FIG. 4, the fuser unit 17 is disposed such that the front end portion of the fuser unit 17 is positioned in front of the front end portion of the fan 78.

As shown in FIGS. 7A and 7B, the airflow amount of air passing through front-side first openings 110 (i.e., first openings 110 disposed close to the fuser unit 17) of the plurality of first openings 110 is secured more than the airflow amount of air passing through rear-side first openings 110 of the plurality of first openings 110. Therefore, it is possible to effectively cool the fuser unit 17.

As shown in FIG. 5, the third openings 112 are disposed at the front cover wall 97 that extends rightward from the front end portion of the regulation wall 84. Therefore, it is possible to certainly let air in front of the fan 78 flow.

As shown in FIG. 4, the high-voltage board 72 is disposed on a lower front side of the fan 78. Further, as shown in FIG. 5, the fan 78 is configured to certainly let air in front of the fan 78 flow via the third openings 112. Thus, it is possible to effectively cool the high-voltage board 72.

As shown in FIGS. 7A and 7B, the extension wall 82 extends leftward continuously from the upper end portion of the inclined section 87. Therefore, the extension wall 82 is allowed to guide air around the first openings 110 toward the first openings 110.

As shown in FIGS. 7A and 7B, the regulation wall 84 is disposed on a left side of the fan 78, to face the fan 78 across a distance. Therefore, there is a space secured between the regulation wall 84 and the fan 78. Hence, when the fan 78 is driven to rotate, it is possible to certainly let air between the regulation wall 84 and the fan 78 flow. Thus, it is possible to certainly increase the airflow amount of air passing through the first openings 110.

As shown in FIGS. 7A and 7B, the regulation wall 84 includes the inclined section 87 and the parallel section 88. Therefore, it is possible to certainly regulate the respective airflow amounts of air passing through the first openings 110 and the second openings 111.

As shown in FIGS. 7A and 7B, the continuous portion 92, which continuously connect the neighbor portion 93 with the separate portion 91 via the continuous portion 92, is disposed on a lower side of the rotational axis A. Therefore, it is possible to inhibit the fan 78 from flowing air positioned below the continuous portion 92, when the fan 78 is driven to rotate.

Therefore, it is possible to restrict the airflow amount of air passing through the second openings 111, and to relatively increase the airflow amount of air passing through the first openings 110.

As shown in FIG. 6, the continuous portion 92 is disposed between the rotational axis A and the lower end portion of the cylindrical portion 100. Therefore, it is possible to properly restrict the airflow amount of air passing through the second openings 111 and increase the airflow amount of air passing through the first openings 110.

As shown in FIGS. 7A and 7B, the neighbor portion 93 is positioned close to the fan 78 in the left-to-right direction. Hence, when the fan 78 is driven to rotate, air around second openings 111 disposed at the neighbor portion 93 certainly flows. Thus, it is possible to ensure an airflow amount of air passing through the second openings 111 disposed at the neighbor portion 93.

Meanwhile, the separate portion 91 is separated farther away from the fan 78 than the neighbor portion 93 in the left-to-right direction. Hence, when the fan 78 is driven to rotate, air passing through the first openings 110 is introduced into a space between the separate portion 91 and the fan 78. Therefore, it is possible to further increase the airflow amount of air passing through the first openings 110 and restrict an airflow amount of air passing through second openings 111 disposed at the separate portion 91. Consequently, the airflow amount of air passing through the second openings 111 disposed at the separate portion 91 is less than the airflow amount of air passing through the second openings 111 disposed at the neighbor portion 93. Namely, it is possible to regulate (adjust) the respective airflow amounts of air passing through the second openings 111 disposed at the separate portion 91 and the second openings 111 disposed at the neighbor portion 93.

As shown in FIG. 4, the fan 78 is disposed to face the right side frame 40R and the rear frame 41, on a right side of them. Nevertheless, the fan cover 77 is allowed to regulate (adjust) the respective airflow amount of air passing through the first openings 110 and the second openings 111. Thus, it is possible to efficiently cool the elements inside the main body casing 2 even in a situation where the fan 78 is disposed to face the right side frame 40R and the rear frame 41, on a right side of them.

As shown in FIG. 3, the fan 78 is attached to the right side cover 42R, so as to face the right side frame 40 R, on a right side of the right side frame 40R. Therefore, the fan 78 is disposed between the right side frame 40R and the plate 50 of the right side cover 42R in the left-to-right direction.

Consequently, when driven to rotate, the fan 78 is allowed to generate the second air current F2 in the accommodation space S between the right side frame 40R and the plate 50 of the right side cover 42R. Thus, it is possible to efficiently cool the elements housed in the accommodation space S.

According to the printer 1, as shown in FIG. 3, the fan 78 is configured to discharge air in the accommodation space S where the low-voltage board 71, the high-voltage board 72, and the control board 73 are disposed, and air in the exhaust space E between the top cover 7 and the scanner frame 28 of the flatbed scanner 10. The extension wall 82 extends toward the fuser unit 17 from the fan cover 77, and separates the accommodation space S from the exhaust space E.

Therefore, the air around the low-voltage board 71, the high-voltage board 72, and the control board 73 is discharged by the fan 78 via the accommodation space S. Further, the air around the fuser unit 17 is discharged by the fan 78 via the exhaust space E. At this time, the extension wall 82 prevents the air in the exhaust space E from flowing into the accommodation space S.

Consequently, it is possible to discharge heat generated in the accommodation space S and the exhaust space E, while preventing the air around the fuser unit 17 (the air containing water vapor evaporated from a sheet at the time of toner fixing) from flowing into the accommodation space S in which the low-voltage board 71, the high-voltage board 72, and the control board 73 are disposed.

Thus, it is possible to prevent humid air having passed through the fuser unit 17 from flowing toward the low-voltage board 71, the high-voltage board 72, and the control board 73, and to discharge heat generated in the main body casing 2.

Further, according to the printer 1, as shown in FIG. 3, the extension wall 82 is disposed higher than the middle portion of the fan cover in the vertical direction.

Thereby, it is possible to make a region of the fan 78 for discharging the air in the accommodation space S larger than a region of the fan 78 for discharging the air in the exhaust space E.

Therefore, it is possible to discharge a larger amount of air in the accommodation space S than an amount of air in the exhaust space E.

Consequently, it is possible to effectively discharge heat generated from the low-voltage board 71, the high-voltage board 72, and the control board 73.

Further, according to the printer 1, as shown in FIG. 3, the extension wall 82 is disposed adjacent to and above the upper end portion of the right side frame 40R, above the upper end portion of the right side frame 40R.

Thus, by the extension wall 82, it is possible to prevent the air in the exhaust space E from flowing into the accommodation space S in which the low-voltage board 71, the high-voltage board 72, and the control board 73 are disposed.

Therefore, it is possible to further prevent the humid air having passed through the fuser unit 17 from flowing toward the low-voltage board 71, the high-voltage board 72, and the control board 73.

Further, according to the printer 1, as shown in FIG. 5, the fan cover 77 is attached to the right side cover 42R.

Therefore, it is possible to stably hold the fan cover 77 by the right side cover 42R.

Further, according to the printer 1, as shown in FIG. 7A, the extension wall 82 extends up to a position closer to the fuser unit 17 than the right side frame 40R in the left-to-right direction. Further, the low-voltage board 71, the high-voltage board 72, and the control board 73 are disposed on an opposite side of the fuser unit 17 with respect to the right side frame 40R.

Therefore, by the right side frame 40R and the extension wall 82, it is possible to certainly define the accommodation space S in which the low-voltage board 71, the high-voltage board 72, and the control board 73 are disposed.

Further, according to the printer 1, as shown in FIG. 1, the top cover 7 includes the plurality of through-holes 63 configured such that the exhaust space E communicates with a space where the fuser unit 17 is disposed via the through-holes 63.

Therefore, it is possible to let the air around the fuser unit 17 smoothly flow into the exhaust space E and discharge the air by the fan 78.

Thus, it is possible to smoothly discharge the heat generated around the fuser unit 17.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein.

What is claimed is:

1. An image forming apparatus comprising:

a casing;

a fan configured to rotate around a rotational axis and let air inside the casing flow; and a fan cover configured to cover the fan, the fan cover comprising:

a wall portion disposed to overlap the rotational axis in an axis direction along the rotational axis, the wall portion extending in an orthogonal direction perpendicular to the axis direction;

a first section disposed on one side relative to the wall portion in the orthogonal direction, the first section having a first opening disposed on one side relative to the fan in the axis direction and on the one side relative to the rotational axis in the orthogonal direction; and a second section disposed on an other side relative to the wall portion in the orthogonal direction, the second section having a second opening disposed on the one side relative to the fan in the axis direction and on the other side relative to the rotational axis in the orthogonal direction, wherein the wall portion comprises an inclined section that is inclined to the one side in the axis direction, toward an end of the inclined section close to the first section from another end of the inclined section close to the second section, an opening area of the first opening is less than an opening area of the second opening, the inclined section is disposed closer to the first section than the rotational axis in the orthogonal direction, the inclined section comprises:

a first inclined portion disposed on one side in a second orthogonal direction, the second orthogonal direction being perpendicular to the axis direction and the orthogonal direction; and a second inclined portion disposed adjacent to the first inclined portion, on an other side relative to the first inclined portion in the second orthogonal direction, and a volume of a space defined by the first inclined portion and the fan is more than a volume of a space defined by the second inclined portion and the fan.

2. The image forming apparatus according to claim 1, wherein an end portion of the first inclined portion on a side close to the second section is closer to the second section than an end portion of the second inclined portion on a side close to the second section.

3. The image forming apparatus according to claim 1, further comprising a fuser unit disposed on the one side relative to the fan in the axis direction, inside the casing, the fuser unit being configured to fix a developer image onto recording medium, wherein an end portion of the fuser unit on the one side in the second orthogonal direction is disposed on the one side relative to the fan in the second orthogonal direction.

4. The image forming apparatus according to claim 1, wherein the fan cover comprises:

a side wall extending toward an other side in the axis direction from an end portion of the wall portion on the one side in the second orthogonal direction; and a third opening of the side wall.

5. The image forming apparatus according to claim 4, further comprising a board disposed on the one side relative to the fan in the second orthogonal direction.

6. The image forming apparatus according to claim 1, further comprising an extension wall extending toward the one side in the axis direction continuously from an end of the inclined section on a side close to the first section, so as to be farther away from the fan.

7. The image forming apparatus according to claim 1, wherein the wall portion is disposed to face the fan across a distance, on the one side relative to the fan in the axis direction.

8. The image forming apparatus according to claim 7, wherein the wall portion is continuously connected with the inclined section, and wherein the wall portion comprises a parallel section parallel to the orthogonal direction and a second orthogonal direction, the second orthogonal direction being perpendicular to the axis direction and the orthogonal direction.

9. The image forming apparatus according to claim 7, wherein the second section comprises:

a neighbor portion disposed closer to the fan in the axis direction than the wall portion;

a separate portion separated farther away from the fan than the neighbor portion;

a continuous portion disposed on the other side relative to the rotational axis in the orthogonal direction, the continuous portion being configured to continuously connect the neighbor portion with the separate portion via the continuous portion.

10. The image forming apparatus according to claim 9, wherein the fan comprises:

a cylindrical portion having a center axis line positionally coincident with the rotational axis; and a plurality of blades extending outward from the cylindrical portion in a radial direction of the cylindrical portion, the plurality of blades being arranged at intervals in a circumferential direction on an outer circumferential surface of the cylindrical portion, and wherein the continuous portion is disposed between the rotational axis and an outer end portion of the cylindrical portion in the radial direction.

11. The image forming apparatus according to claim 10, wherein the second opening is disposed at the neighbor portion and the separate portion.

12. The image forming apparatus according to claim 1, further comprising:

an image forming unit housed in the casing, the image forming unit being configured to form an image on a recording medium; and an image scanner disposed above the casing, the image scanner being configured to read a document sheet, wherein the casing comprises:

a frame disposed on the one side relative to the fan in the axis direction, the frame being configured to support the image forming unit; and a first cover disposed to face the frame in a second orthogonal direction, below the image scanner, the second orthogonal direction being perpendicular to the axis direction and the orthogonal direction, and wherein the fan is disposed to face the frame and the first cover, on an other side relative to the frame and the first cover in the axis direction.

13. The image forming apparatus according to claim 12, wherein the casing comprises a second cover disposed on the other side relative to the frame in the axis direction, the second cover being configured to cover the frame from the other side in the axis direction, and wherein the fan and the fan cover are attached to the second cover.

14. An image forming apparatus comprising:

a casing;

a fan configured to let air inside the casing flow; and a fan cover configured to cover the fan;

a fuser unit disposed on one side relative to the fan in an axis direction along a rotational axis of the fan, inside the casing, the fuser unit being configured to fix a developer image onto recording medium;

a frame disposed on the one side relative to the fan in the axis direction, the frame being configured to support the fuser unit;

an upper cover configured to cover an upper side of the fuser unit;

an image scanner disposed above the upper cover, the image scanner being configured to read an image of a document sheet; and a board disposed on an other side relative to the frame in the axis direction, wherein the fan cover comprises an extension wall extending toward the fuser unit, the extension wall being configured to separate a first space configured to accommodate the board from a second space between the upper cover and the image scanner, and the extension wall extends up to a position closer to the fuser unit than the frame in the axis direction.

15. The image forming apparatus according to claim 14, wherein the first space is disposed below the extension wall, and wherein the extension wall is disposed above a middle portion of the fan cover in a vertical direction.

16. The image forming apparatus according to claim 14, wherein the extension wall is disposed above the frame.

17. The image forming apparatus according to claim 14, further comprising a second cover disposed on an opposite side of the frame with respect to the board, wherein the fan cover is attached to the second cover.

18. The image forming apparatus according to claim 14, wherein the upper cover comprises a through-hole configured such that the second space communicates with a space where the fuser unit is disposed, via the through-hole.

19. An image forming apparatus comprising:

a casing;

a fan configured to let air inside the casing flow;

a fan cover configured to cover the fan;

a fuser unit disposed on one side relative to the fan in an axis direction along a rotational axis of the fan, inside the casing, the fuser unit being configured to fix a developer image onto recording medium; and a frame disposed on the one side relative to the fan in the axis direction, the frame being configured to support the fuser unit, wherein the fan cover comprises an extension wall extending toward the one side in the axis direction, from an end portion of the fan cover up to a position closer to the fuser unit than the frame in the axis direction.

* * * * *